US010975888B2

(12) United States Patent
Chen et al.

(10) Patent No.: US 10,975,888 B2
(45) Date of Patent: Apr. 13, 2021

(54) FAN

(71) Applicant: DELTA ELECTRONICS, INC., Taoyuan (TW)

(72) Inventors: Kun-Hung Chen, Taoyuan (TW); Pao-Hung Tung, Taoyuan (TW); Shih-Tzung Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 98 days.

(21) Appl. No.: 16/022,251

(22) Filed: Jun. 28, 2018

(65) Prior Publication Data

US 2019/0226499 A1 Jul. 25, 2019

(30) Foreign Application Priority Data

Jan. 25, 2018 (CN) ..... 201820130713.3

(51) Int. Cl.

| | |
|---|---|
| ***F04D 29/66*** | (2006.01) |
| ***F04D 29/42*** | (2006.01) |
| ***F04D 25/06*** | (2006.01) |
| ***F04D 25/08*** | (2006.01) |

(52) U.S. Cl.

CPC ..... *F04D 29/665* (2013.01); *F04D 25/06* (2013.01); *F04D 25/0606* (2013.01); *F04D 25/08* (2013.01); *F04D 29/4226* (2013.01); *F04D 29/664* (2013.01)

(58) Field of Classification Search

CPC .... F04D 29/665; F04D 25/06; F04D 25/0606; F04D 25/08; F04D 29/4226; F04D 29/664

See application file for complete search history.

(56) References Cited

U.S. PATENT DOCUMENTS

| | | | | |
|---|---|---|---|---|
| 3,949,830 A * | 4/1976 | Muehlbauer | ..... | F01N 1/10 181/224 |
| 4,174,020 A * | 11/1979 | Challis | ..... | F04D 29/424 181/211 |
| 5,199,846 A * | 4/1993 | Fukasaku | ..... | B60H 1/00471 415/119 |
| 5,326,317 A * | 7/1994 | Ishizu | ..... | F04D 29/665 454/354 |
| 5,336,046 A * | 8/1994 | Hashimoto | ..... | B60H 1/00471 415/119 |

* cited by examiner

*Primary Examiner* — Michael Lebentritt
*Assistant Examiner* — Eric J Zamora Alvarez
(74) *Attorney, Agent, or Firm* — Muncy, Geissler, Olds & Lowe, P.C.

(57) ABSTRACT

A fan includes a frame, a first impeller, a motor, a base, and a noise silencer. The frame is provided with a flow channel for air to flow through. The first impeller is disposed in the frame. The motor connects with and drives the first impeller to rotate. The base is disposed in the frame and supports the motor. The noise silencer is located adjacent to the flow channel. The noise silencer includes at least one hollow chamber, and the hollow chamber has at least one hole communicating with the flow channel.

10 Claims, 7 Drawing Sheets

FAN

CROSS REFERENCE TO RELATED APPLICATIONS

This Non-provisional application claims priority under 35 U.S.C. § 119(a) on Patent Application No(s). 201820130713.3 filed in People's Republic of China on Jan. 25, 2018, the entire contents of which are hereby incorporated by reference.

BACKGROUND OF THE INVENTION

Field of Invention

This disclosure relates to a fan that can effectively reduce the fan noise without affecting the heat dissipation efficiency.

Related Art

As the progress of technical industry, the electronic devices, such as the desktop computer, notebook computer, smart phone, tablet, or the likes, have been frequently used in our daily lives. The internal electronic components of the electronic device will generate a lot of heat during the operation of the electronic device, and the generated heat can affect the operation performance of the electronic device. Accordingly, the electronic device is usually configured with a proper heat dissipation system for dissipating the generated heat.

The common heat dissipation system usually includes a fan. The conventional fan includes a frame and blades disposed in the frame. When the motor drives the fan to rotate, an airflow can be induced to dissipate the heat. However, the operating fan will have friction with air so as to generate noise, which may cause uncomfortable to the users. Therefore, it is desired to provide a fan that can effectively reduce the fan noise without affecting the heat dissipation efficiency.

SUMMARY OF THE INVENTION

An objective of this disclosure is to provide a fan that can effectively reduce the fan noise without affecting the heat dissipation efficiency.

This disclosure provides a fan including a frame, a first impeller, a motor, a base, and a noise silencer. A flow channel for air to flow through is provided within the frame. The first impeller is disposed in the frame. The motor connects with the first impeller and drives the first impeller to rotate. The base is disposed in the frame and supports the motor. The noise silencer is located adjacent to the flow channel. The noise silencer includes at least a hollow chamber, and the hollow chamber has at least a hole communicating with the flow channel.

In one embodiment, the noise silencer includes a plurality of hollow chambers, and the hollow chambers have the same volume.

In one embodiment, the noise silencer includes a plurality of hollow chambers, and the hollow chambers have different volumes.

In one embodiment, the hollow chambers are not communicated with each other.

In one embodiment, the hollow chambers are communicated with each other.

In one embodiment, the hollow chamber has a plurality of holes.

In one embodiment, the fan is an axial-flow fan and further includes a second impeller. The second impeller is disposed in the frame and departed from the first impeller. The motor also connects with the second impeller and drives the second impeller to rotate.

In one embodiment, the noise silencer is located between the first impeller and the second impeller.

In one embodiment, the first impeller is located between the noise silencer and the second impeller.

In one embodiment, the fan further includes a plurality of connecting members disposed on a periphery of the base and connected between the base and the frame.

In one embodiment, the hollow chamber is filled with a porous sound-absorbing material.

In one embodiment, the fan is a multistage blower and further includes a second impeller. The second impeller is disposed in the frame and departed from the first impeller. The motor also connects with the second impeller and drives the second impeller to rotate.

As mentioned above, the fan of this disclosure includes a noise silencer disposed adjacent to the flow channel. The noise silencer has at least one hollow chamber, and the hollow chamber has at least one hole communicated with the flow channel. Accordingly, the noise of specific frequency can be transmitted to the hollow chamber through the hole and be eliminated. As a result, the fan of this disclosure can effectively reduce the fan noise without affecting the heat dissipation efficiency.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

The fan of this disclosure can effectively reduce the fan noise without affecting the heat dissipation efficiency. The structures and features of the fan will be described in the following embodiments.

Figure 1A:
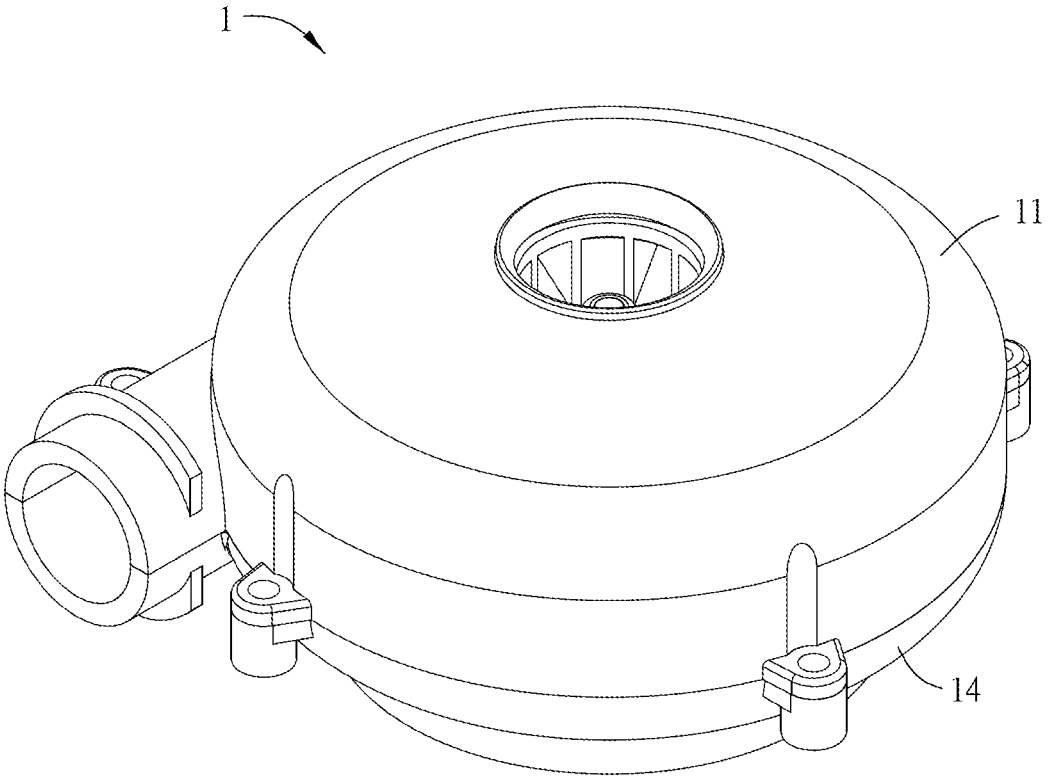
FIGS. 1A to 1C are schematic diagrams showing a fan according to an embodiment of the disclosure.
Figure 1B:
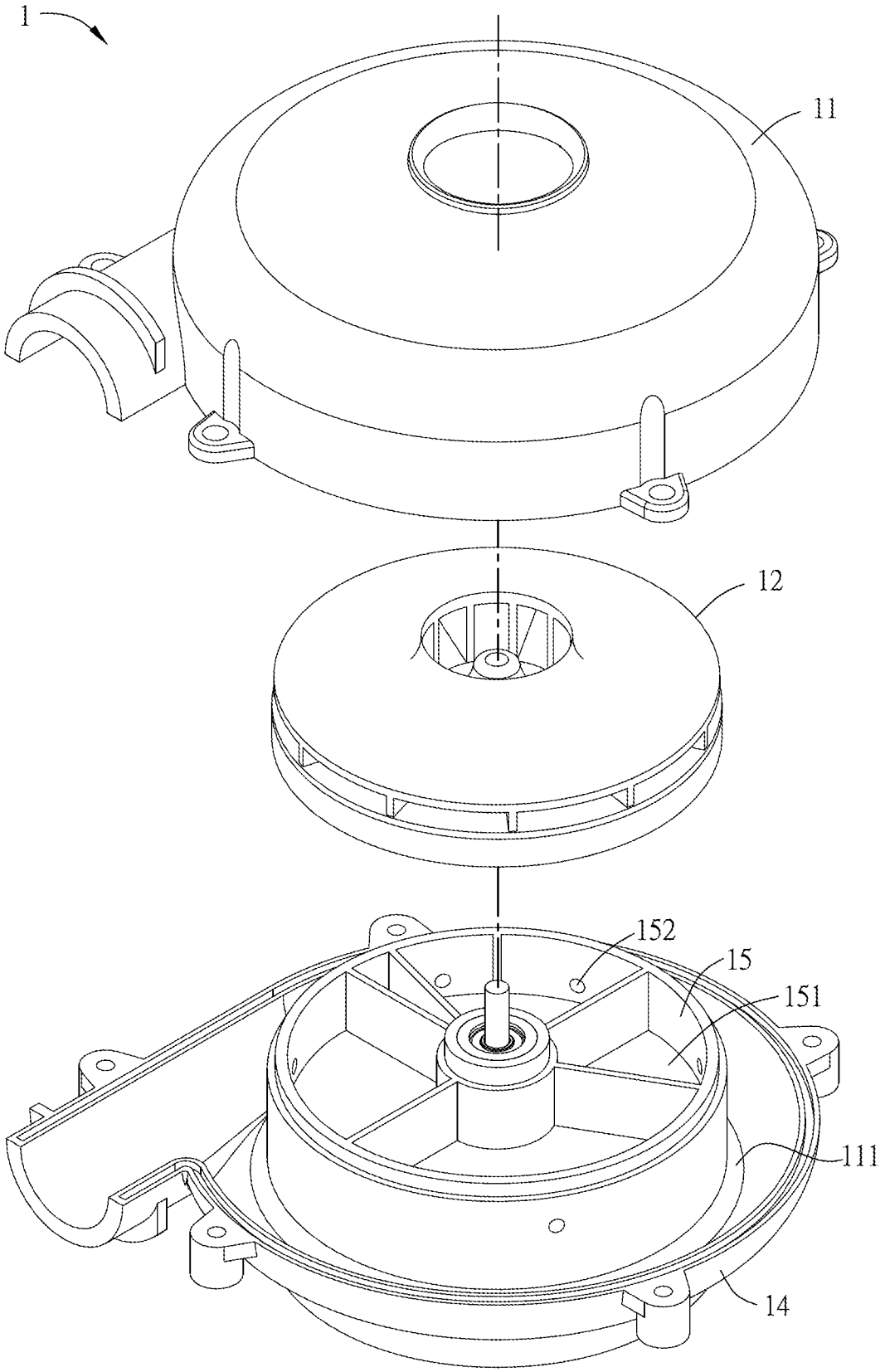
Figure 1C:
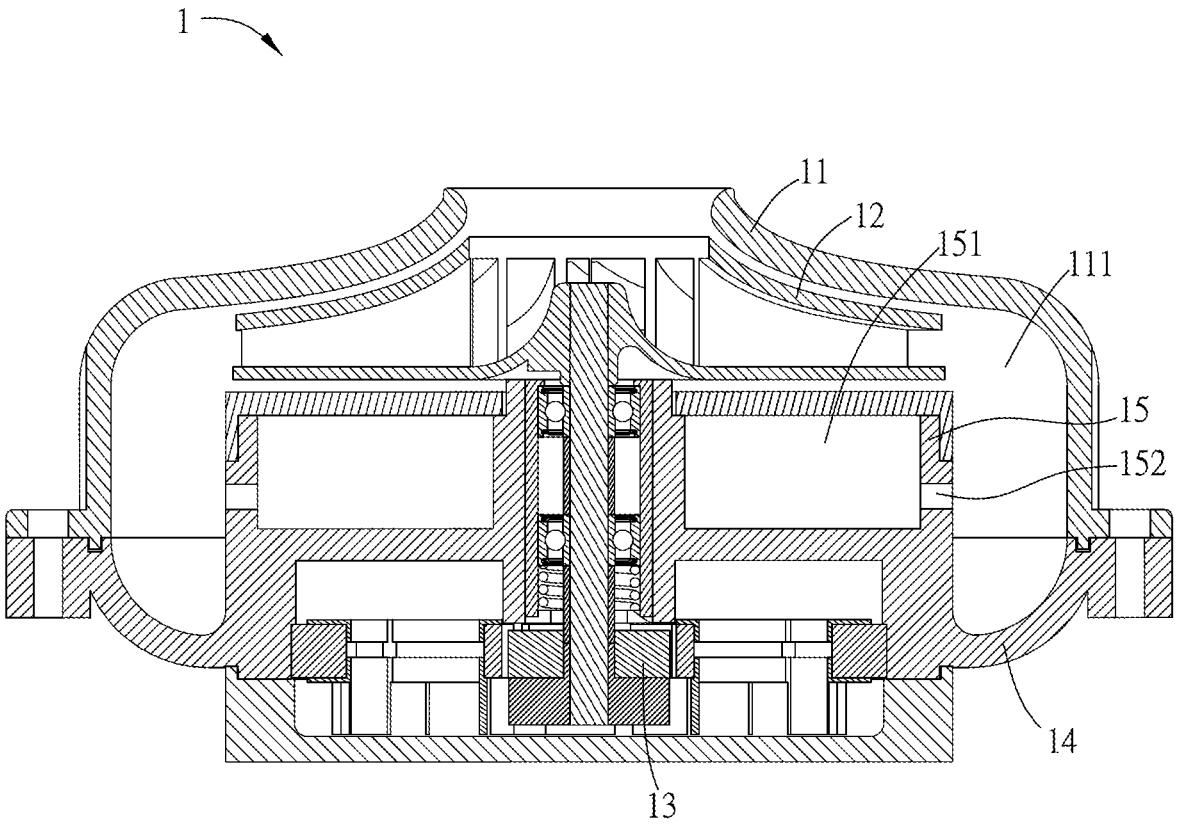

FIGS. 1A to 1C are schematic diagrams showing a fan 1 according to an embodiment of the disclosure, and FIGS. 2A to 2D are schematic diagrams showing fans 1 according to different embodiments of the disclosure. As shown in FIGS. 1A to 2D, the fan 1 includes a frame 11, a first impeller 12, a motor 13, a base 14 and a noise silencer 15.

Referring to FIGS. 1A to 1C, a flow channel 111 for air to flow through is provided within the frame 11. The motor 13 connects with the first impeller 12 and drives the first impeller 12 to rotate. The base 14 is disposed in the frame 11 and supports the motor 13. The noise silencer 15 is located adjacent to the flow channel 111. The noise silencer 15 includes at least a hollow chamber 151, and the hollow chamber 151 has at least a hole 152 communicating with the flow channel 111.

In this embodiment, the noise silencer 15 is located at the inner side of the flow channel 111. In other words, the noise silencer 15 is disposed surrounding the rotating axis as shown in FIG. 1B. Alternatively, the noise silencer 15 is located at the outer side of the flow channel 111. In other words, the noise silencer 15 is disposed at four corners between the frame 11 and the flow channel 111 (not shown).

Figure 2A:
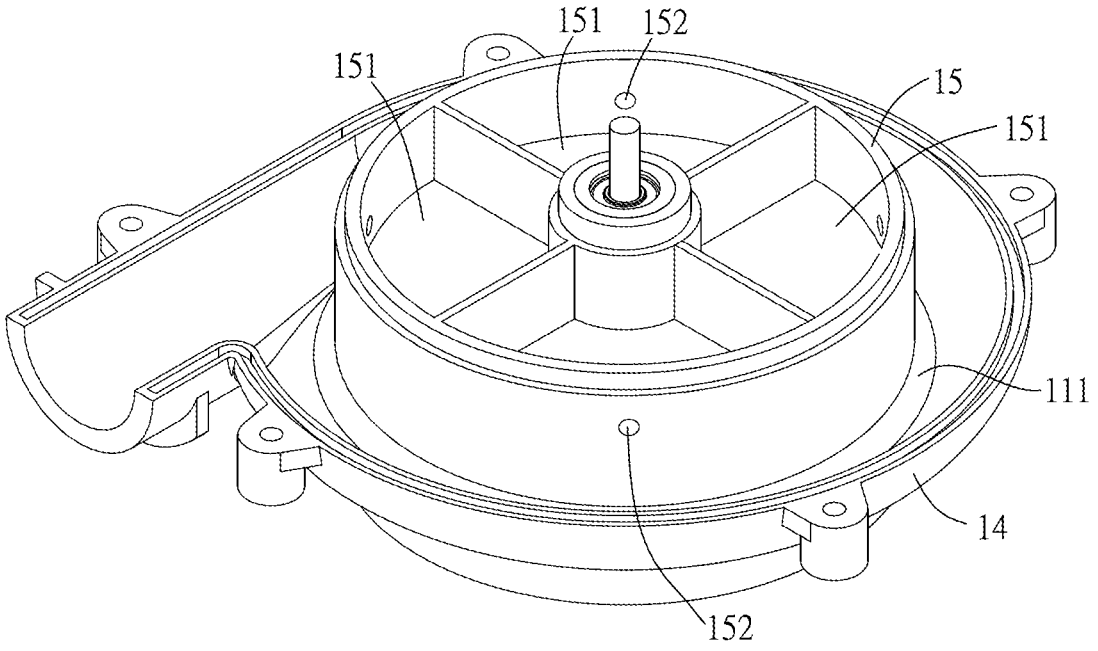
FIGS. 2A to 2D are schematic diagrams showing fans according to different embodiments of the disclosure.

FIG. 2A is a schematic diagram showing a fan 1 according to another embodiment of the disclosure. In this embodiment, the noise silencer 15 includes a plurality of hollow chambers 151, and the hollow chambers 151 have the same volume.

Figure 2B:
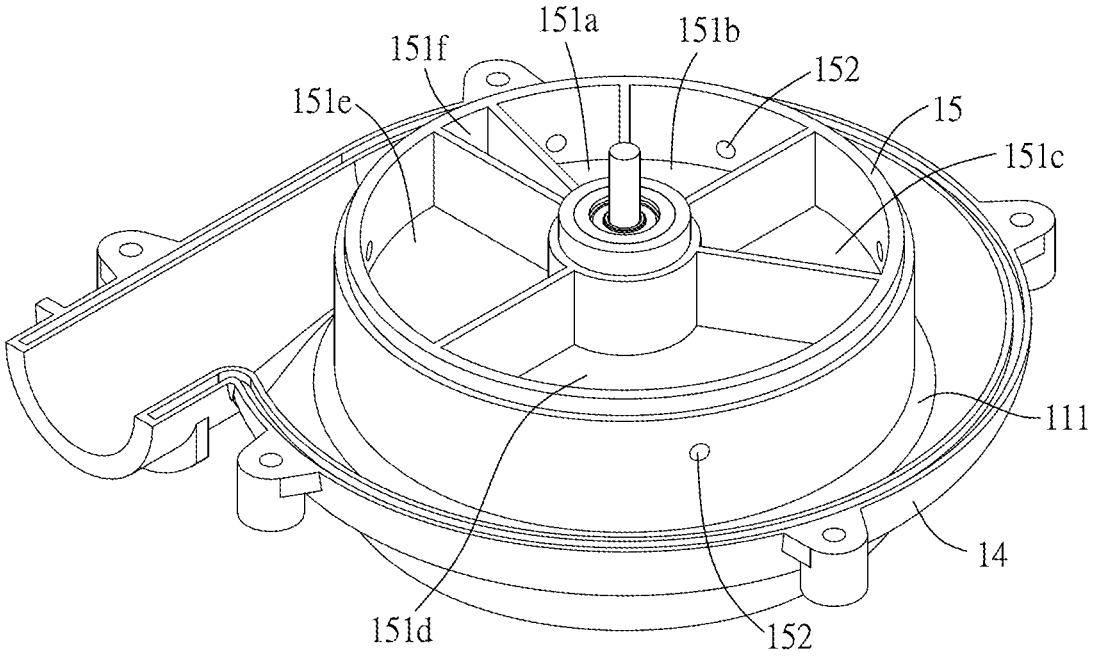

FIG. 2B is a schematic diagram showing a fan 1 according to another embodiment of the disclosure. In this embodiment, the noise silencer 15 includes a plurality of hollow chambers 151*a*, 151*b*, 151*c*, 151*d*, 151*e* and 151*f*, and the hollow chambers 151*a*, 151*b*, 151*c*, 151*d*, 151*e* and 151*f* have different volumes.

As shown in FIG. 2A, the hollow chambers 151 are not communicated with each other. In other words, the hollow chambers 151 are arranged in parallel. As shown in FIG. 2B, the hollow chambers 151*a*, 151*b*, 151*c*, 151*d*, 151*e* and 151*f* are not communicated with each other. In other words, the hollow chambers 151*a*, 151*b*, 151*c*, 151*d*, 151*e* and 151*f* are arranged in parallel.

Figure 2C:
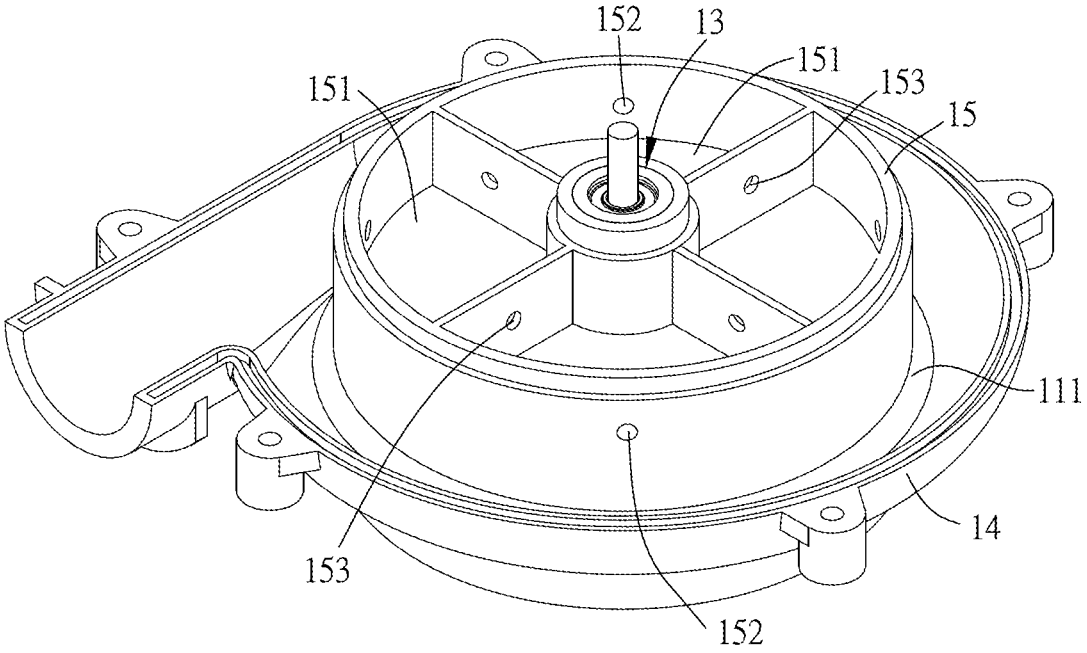

FIG. 2C is a schematic diagram showing a fan 1 according to another embodiment of the disclosure. In this embodiment, a hole 153 is configured between two adjacent hollow chambers 151, so that the hollow chambers 151 are communicated with each other. In other words, the hollow chambers 151 are arranged in series.

Figure 2D:
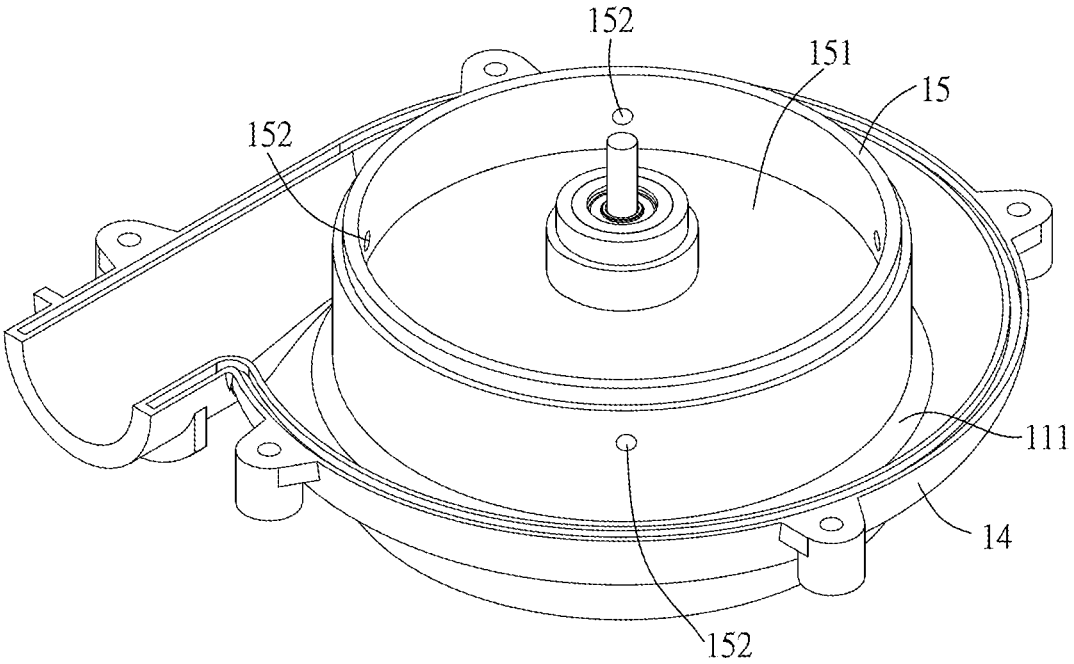

FIG. 2D is a schematic diagram showing a fan 1 according to another embodiment of the disclosure. In this embodiment, the noise silencer 15 includes one hollow chamber 151 only, and the hollow chamber 151 has a plurality of holes 152. In particular, the noise silencer 15 may include one or more hollow chambers 151, and each hollow chamber 151 may include one or more holes 152. This disclosure is not limited.

In this embodiment, the hollow chamber 151 can be filled with a porous sound-absorbing material.

In this embodiment, the equivalent volume of the hollow chamber 151 of the noise silencer 15 is V, the equivalent length of the hole 152 is L, and the equivalent diameter of the hole 152 is $S_b$. Then, the noise silencer 15 matches the following Helmholtz equation:

$$f_c = \left(\frac{c}{2\pi}\right)\sqrt{\left(\frac{S_b}{LV}\right)}$$

Wherein, $f_c$ is the frequency, and c is the sound speed.

In this embodiment, the equivalent volume of the hollow chamber 151 is between 100 $mm^3$ and 3,000 $mm^3$. The equivalent length of the hole 152 is between 0.5 mm and 5 mm, and the equivalent diameter of the hole 152 is between 0.5 mm and 5 mm. In particular, the shapes of the hollow chamber 151 and the hole 152 and the flowing motion of the airflow can influence the calculation of frequency. In this embodiment, the equivalent volume, the equivalent length and the equivalent diameter can involve the real value and ideal value of the calculated frequency, and this disclosure is not limited.

Figure 3:
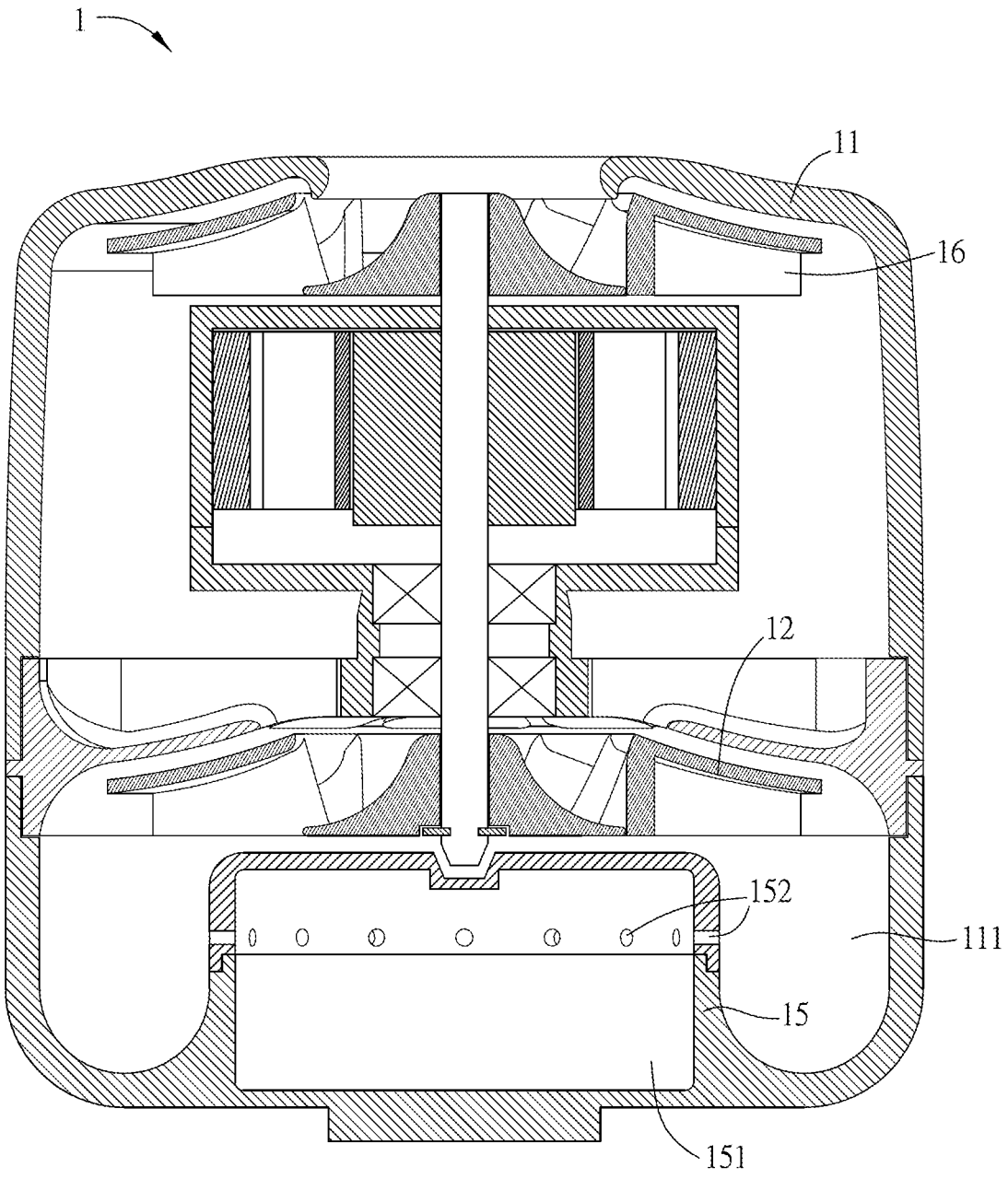
FIG. 3 is a schematic diagram showing a fan according to another embodiment of the disclosure.

In this embodiment, the fan 1 can be an axial-flow fan, a centrifugal fan or a blower. As shown in FIG. 3, when the fan 1 is a multistage blower, the fan 1 further includes a second impeller 16. The second impeller 16 is disposed in the frame 11 and departed from the first impeller 12. The motor 13 also connects with the second impeller 16 and drives the second impeller 16 to rotate (not shown).

As shown in FIG. 3, the first impeller 12 is located between the noise silencer 15 and the second impeller 16. In addition, the noise silencer 15 can be located between the first impeller 12 and the second impeller 16 (not shown).

Figure 4:
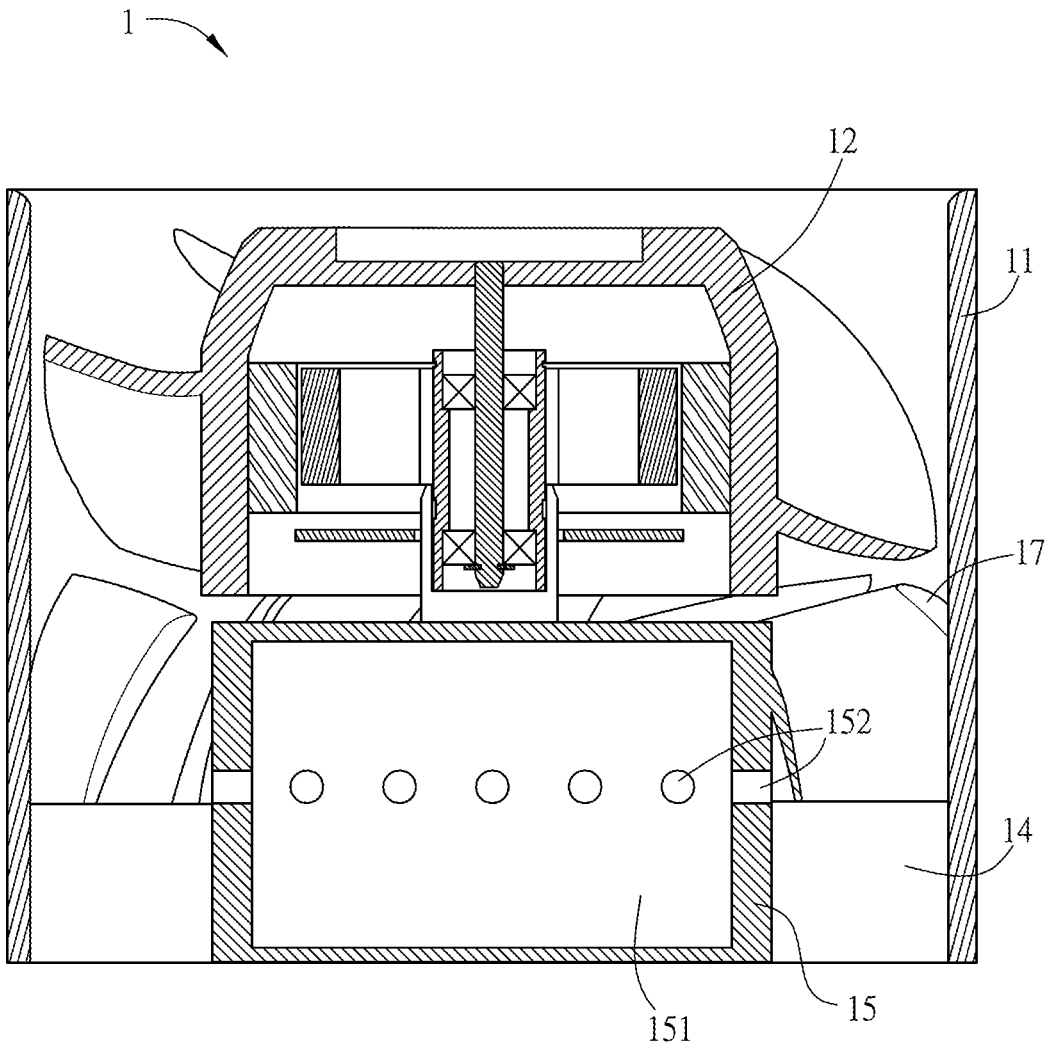
FIG. 4 is a schematic diagram showing a fan according to another embodiment of the disclosure.

FIG. 4 is a schematic diagram showing a fan 1 according to another embodiment of the disclosure. In this embodiment, the fan 1 is an axial-flow fan. As shown in FIG. 4, the fan 1 further includes a plurality of connecting members 17 disposed on a periphery of the base 14 and connected between the base 14 and the frame 11. The connecting members 17 can be static blades or ribs, and this disclosure is not limited. The noise silencer 15 is disposed inside the base 14 and located underneath the first impeller 12.

As mentioned above, the fan 1 of this disclosure can be, for example but not limited to, an axial-flow fan, a centrifugal fan or a blower. The noise silencer 15 is disposed adjacent to the flow channel 111. The noise silencer 15 has at least one hollow chamber 151, and the hollow chamber 151 has at least one hole 152 communicated with the flow channel 111. Accordingly, the noise of specific frequency can be transmitted to the hollow chamber 151 through the hole 152 and be eliminated. As a result, the fan 1 of this disclosure can effectively reduce the fan noise without affecting the heat dissipation efficiency.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:
- a frame, wherein a flow channel for air to flow through is provided within the frame;
- a first impeller disposed in the frame;
- a motor connecting with the first impeller and driving the first impeller to rotate;
- a base disposed in the frame and supporting the motor;
- a noise silencer located between the impeller and the motor and located inside the flow channel and underneath the impeller, wherein the noise silencer comprises at least one hollow chamber, and the at least one hollow chamber has at least one hole communicating with the flow channel; and
- a shaft disposed through the noise silencer.

2. The fan according to claim 1, wherein the noise silencer comprises a plurality of hollow chambers, and the hollow chambers have the same volume.

3. The fan according to claim 2, wherein the plurality of hollow chambers are not communicated with each other.

4. The fan according to claim 2, wherein the plurality of hollow chambers are communicated with each other.

5. The fan according to claim 1, wherein the noise silencer comprises a plurality of hollow chambers, and the hollow chambers have different volumes.

6. The fan according to claim 5, wherein the plurality of hollow chambers are not communicated with each other.

7. The fan according to claim 5, wherein the plurality of hollow chambers are communicated with each other.

8. The fan according to claim 1, wherein the at least one hollow chamber has a plurality of holes.

9. The fan according to claim 1, wherein the at least one hollow chamber is filled with a porous sound-absorbing material.

10. The fan according to claim 1, wherein the noise silencer comprises a plurality of hollow chambers, and a largest one of the hollow chambers is proximate a flow opening of the frame.

* * * * *